US006138418A

United States Patent [19]

Dyer et al.

[11] Patent Number: 6,138,418

[45] Date of Patent: Oct. 31, 2000

[54] SOFFIT AND FASCIA SYSTEM

[75] Inventors: William J. Dyer, Berwyn, Pa.; Robert L. Walker, Wilmington, Del.; Joseph Levangie, Frnaklin, Ohio; Jonathan C. Hauberg, Beavercreek, Ohio; Sylvia S. Moore, Springboro, Ohio

[73] Assignee: Arco Extrusion Corp., Wlimington, Del.

[21] Appl. No.: 09/265,090

[22] Filed: Mar. 9, 1999

Related U.S. Application Data

[60] Provisional application No. 60/078,284, Mar. 17, 1998.

[51] Int. Cl.[7] ..... E04B 1/62

[52] U.S. Cl. ..... 52/94; 52/95; 52/96; 52/90.2

[58] Field of Search ..... 52/94, 95, 96, 52/90.2

[56] References Cited

U.S. PATENT DOCUMENTS

| | | | |
|---|---|---|---|
| 3,181,275 | 5/1965 | Schroter et al. | 52/94 X |
| 4,189,878 | 2/1980 | Fitzgerald | 52/95 |
| 4,461,128 | 7/1984 | Knoebl | 52/94 |
| 4,580,374 | 4/1986 | Quinnell | 52/95 |
| 4,622,789 | 11/1986 | Quinnell | 52/95 |
| 5,377,463 | 1/1995 | Howe | 52/95 X |
| 5,657,585 | 8/1997 | Zaccagni | 52/94 |
| 5,850,717 | 12/1998 | Schiedegger et al. | 52/94 X |
| 5,937,592 | 8/1999 | Tamlyn | 52/95 |
| 5,946,864 | 9/1999 | Simpson | 52/94 |

FOREIGN PATENT DOCUMENTS

| | | | |
|---|---|---|---|
| 1347674 | 2/1974 | United Kingdom | 52/94 |

*Primary Examiner*—Carl D. Friedman
*Assistant Examiner*—Phi Dieu Trana A
*Attorney, Agent, or Firm*—Connolly Bove Lodge & Hutz, LLP

[57] ABSTRACT

A fascia board includes locking structure on an exposed surface for receiving complementary locking structure from an extruded soffit retainer which snaps into the locking structure of the fascia board. The retainer includes a leg for holding a soffit between the fascia board and the leg.

10 Claims, 3 Drawing Sheets

Fig. 2.

SOFFIT AND FASCIA SYSTEM

CROSS-REFERENCE TO RELATED APPLICATION

This application is based on provisional application Ser. No. 60/078,284, filed Mar. 17, 1998.

BACKGROUND OF THE INVENTION

It is conventional to provide the underside of roof structures with protection such as fascia boards which extend across the ends of the roof rafters. It is also conventional to provide a soffit for bridging the gap between the fascia boards and the adjacent wall of the building. Generally, such components are made of wood although it is known to use a plastic or aluminum fascia sheet attached by nails or other suitable fasteners.

SUMMARY OF THE INVENTION

An object of this invention is to provide improved soffit and fascia components.

In accordance with this invention the fascia board and soffit retainer components are extruded from a plastic material such as PVC. The fascia board includes receiving structure into which complementary attaching structure of the soffit retainer is mounted. As a result the fascia board and soffit retainer can be snapped into engagement with each other.

THE DRAWINGS

DETAILED DESCRIPTION

Figure 1:
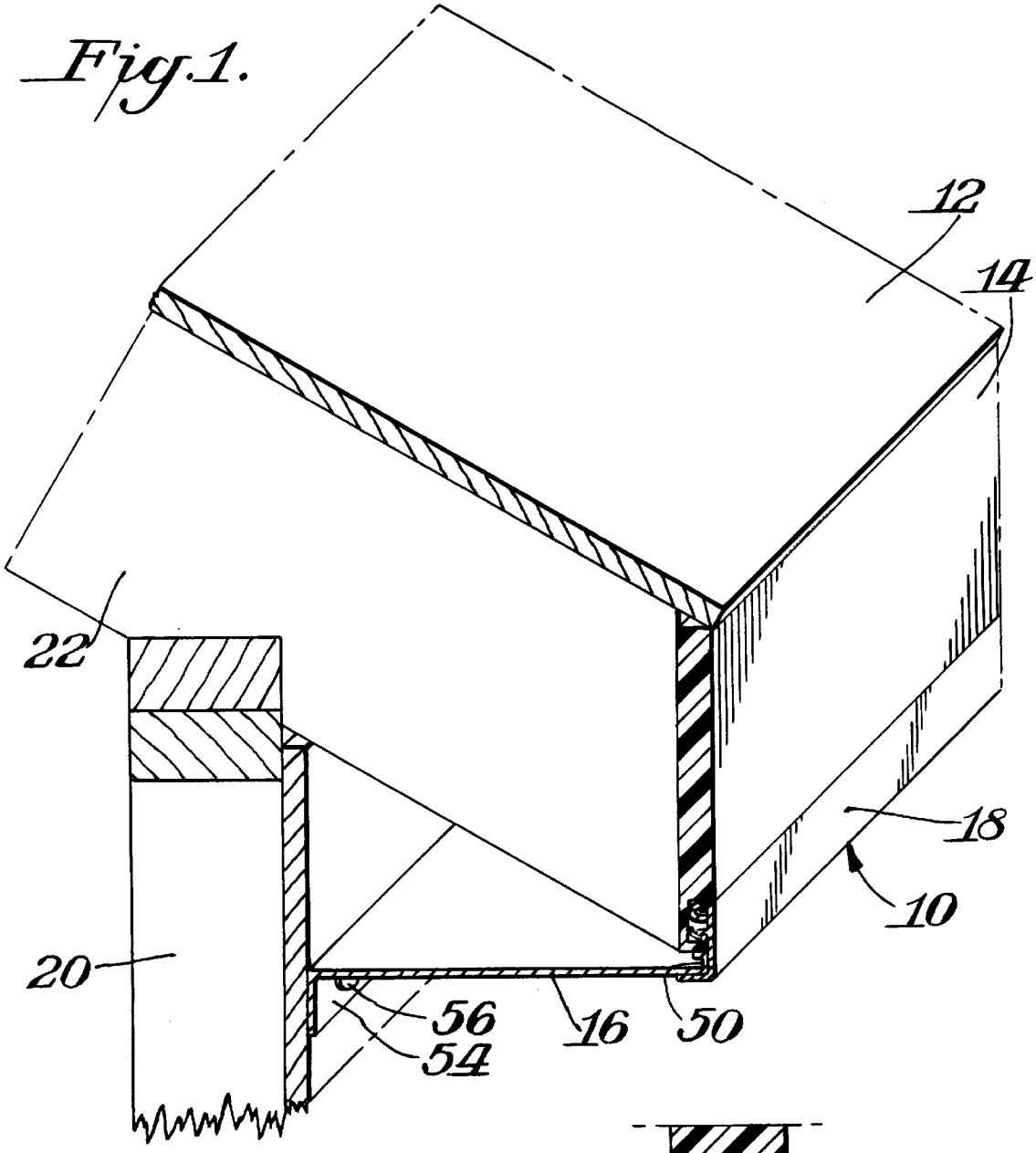
FIG. 1 is a perspective view partly in section showing the mounting of a system which includes a fascia board and soffit retainer and soffit secured to the roof of a building.

FIG. 1 illustrates a soffit and fascia system 10 in accordance with this invention. As shown therein the system 10 is mounted beneath the roof sheathing 12. The system includes a fascia board 14, a soffit 16 and a soffit retainer 18. The soffit 16 is shown as being secured to a stud 20 which supports the rafter 22.

Figure 2:
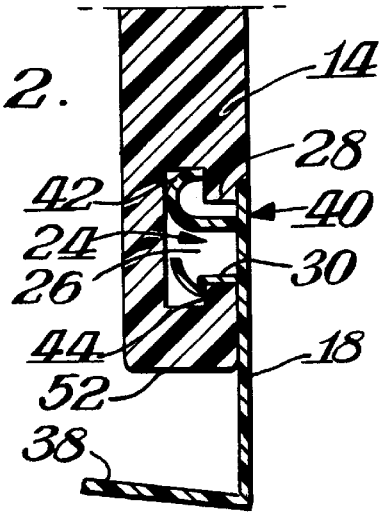
FIG. 2 is a cross-section showing the assembled fascia board and soffit retainer.
Figure 4:
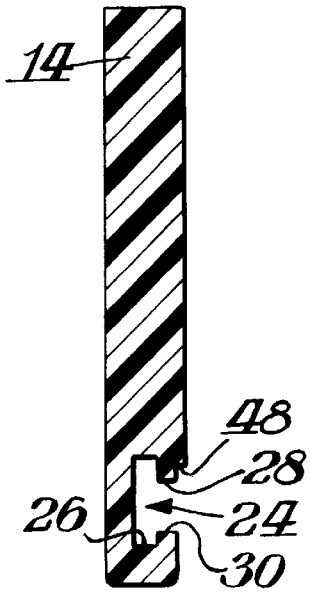
FIG. 4 is a cross-sectional side view in elevation of the fascia board shown in FIG. 3.
Figure 3:
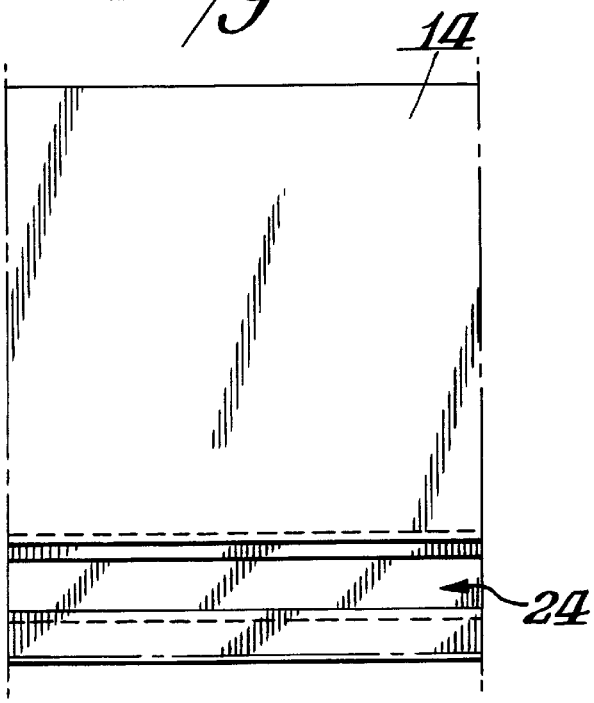
FIG. 3 is a front elevational view of a fascia board as shown in FIGS. 1–2.
Figure 8:
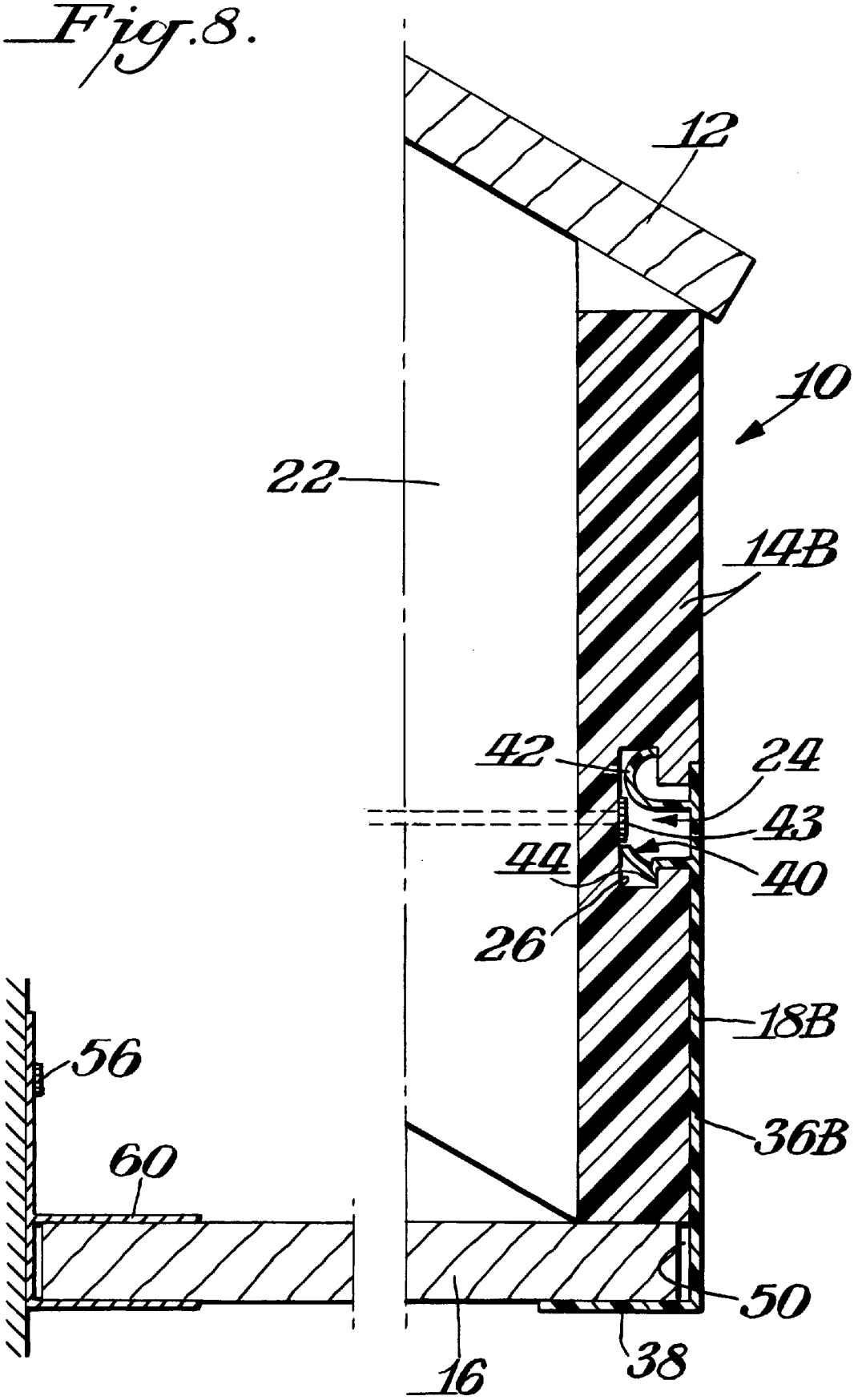
FIG. 8 is a cross-sectional view in elevation of the system similar to that of FIG. 1 with a modified fascia board and soffit retainer.

FIGS. 3–4 illustrate the fascia board 14. As shown therein fascia board 14 is made of a suitable material preferably extruded PVC, although other suitable materials may be used. In the embodiment of FIG. 4 the fascia board is a solid block of material. One end of fascia board 14 has locking structure 24. The locking structure includes a T-shaped slot or recess 26 inwardly of a pair of flanges or lock shoulders 28,30. Flanges 28 and 30 are slightly indented from the outer surface of fascia board 14, as is apparent from the shoulder 48. The indented surface is for aesthetics and conventional look and is not necessary for practicing the invention. The indented surface enables the fascia board and the vertical wall of retainer 18 to be coplanar, as shown in FIGS. 2 and 8.

Figure 5:
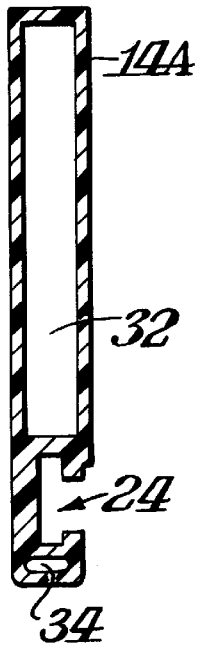
FIG. 5 is a view similar to FIG. 4 of a modified form of fascia board.

The embodiment of FIG. 5 differs from that of FIG. 4 in that the fascia board 14A is of hollow construction having a cavity 32 and a smaller cavity 34. This embodiment would be more lightweight.

Figure 6:
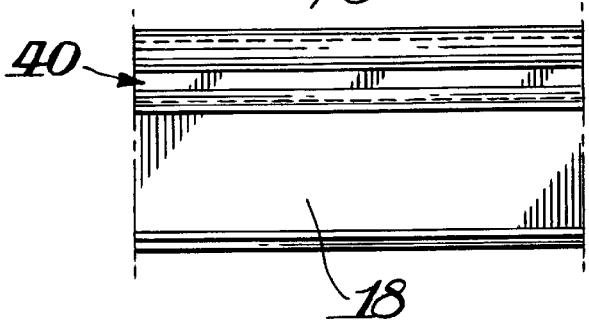
FIG. 6 is a front elevational view of a soffit retainer used with the fascia board of this invention.
Figure 7:
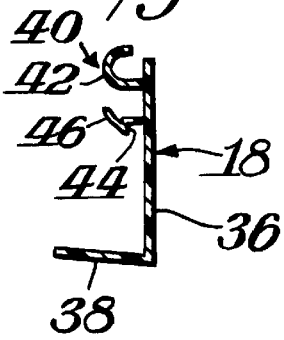
FIG. 7 is a cross-sectional view in elevation of the soffit retainer shown in FIG. 6.

FIGS. 6–7 show the details of the generally L-shaped soffit retainer 18. As shown therein retainer 18 includes a vertical base wall or resilient lock leg 36 with an inwardly and slightly upwardly angled resilient lower leg 38. Locking structure 40 is provided for engagement with the locking structure 24 with fascia board 14. Specifically the locking structure 40 includes a C-shaped integral clip 42 and an integral pawl 44 which terminates in a tooth 46.

FIG. 2 best illustrates the engagement of locking structures 24 and 40. As shown therein, the clip 42 is engaged over the flange or shoulder 28 of T-shaped slot 26 while the pawl 44 is engaged with the lower flange or shoulder 30. The upper shoulder 48 provided at flange 28 is dimensioned to receive lock leg 36 of soffit retainer 18 by being of the same thickness as lock leg 36 so that a continuous planar surface results. Because the material for retainer 18 has inherent resiliency the clip 42 and pawl 44 firmly snap into place against flange 30. Similarly, the inclined leg 38 effectively holds the end of soffit 16 (shown in FIG. 1). The sloping surfaces of the clip 42 and of the tooth 46 facilitate the clip and the pawl snapping into the T-shaped slot to engage the lock shoulders 28,30.

As illustrated in FIG. 1, one end of soffit 16 is clamped in place by having its U-shaped configuration end 50 disposed between the leg 38 and lower end 52 of fascia board 14. Soffit 16 may terminate at its opposite end in a downwardly extending flange 54 which could be nailed or otherwise secured to the building structure.

In one practice of the invention the soffit 16 would be mounted to the building structure through use of fasteners such as nails 56 through flange 54. (Instead of a flange 54, soffit 16 could be mounted to bracket 60 as shown in FIG. 8.) The retainer 18 would then be positioned so that the end 50 of sof fit 16 is disposed on leg 38 of retainer 18. Retainer 18 would then be snapped into engagement with fascia board 14 by pushing the upper end of retainer 18 so that its locking structure 40 engages the locking structure 24 of fascia board 14.

FIG. 2 illustrates the fascia board 14 to have its locking structure 24 near the lower end of the fascia board. FIG. 8, however, illustrates a variation of the invention where the locking structure 24 is located higher on the fascia board and almost to the mid-portion thereof. In this practice of the invention the retainer 18B would have an elongated leg 36B so that its locking structure 40 would be properly positioned to engage locking structure 24 of fascia board 14B. As shown in FIG. 8 fascia board could be mounted to the rafter by a nail 43 located at the slot 26. This variation will also allow the carpenter to nail the soffit to the bottom of the board 14B prior to installing the retainer 18B. For example, if the locking structure 24 is located at least two inches above the lower edge there is a sufficient distance allowed to permit the installer to use nails as the installer normally would when installing siding.

Preferably, the fascia board 14 or 14A or 14B and the soffit retainer 18 and the soffit 16 are extruded from PVC material. If desired soffit 16 may be made of other materials, such as aluminum. The locking structure 40 for retainer 18 or 18B is of a type which has been effectively used in window construction but not heretofore used as a soffit retainer. Such locking structure is effective since it can result as integral components of an extruded retainer member 18 or 18B.

The invention thus provides a fascia board which allows for the builder to insert the fascia board with its recess and flange facing inward toward the structure so that it can also be used as a rake board.

What is claimed is:

1. A soffit and fascia system comprising a fascia board having locking structure, a soffit retainer having complementary locking structure engaged with said locking structure of said fascia board, a soffit held between the soffit retainer and fascia board, and said soffit retainer being made from an extruded plastic material wherein said fascia board includes a recess on an exposed surface, said locking structure including a lock shoulder at said recess, and said complementary locking structure including a clip on said soffit retainer resiliently engaged with said lock shoulder.

2. The system of claim 1 wherein said lock shoulder is a first lock shoulder, a second lock shoulder is at said recess to comprise part of said locking structure, and said complementary locking structure including a pawl mounted to said soffit retainer and resiliently engaged with said second lock shoulder.

3. The system of claim 2 when said recess is T-shaped with said first lock shoulder and said second lock shoulder being at the entrance of said recess, and said first lock shoulder and said second lock shoulder being aligned with each other.

4. The system of claim 3 wherein said clip and said pawl are mounted at the upper end of a resilient lock leg of said soffit retainer.

5. The system of claim 4 wherein said clip is C-shaped with a sloping surface, said pawl terminating in a tooth having a sloping surface, and said sloping surfaces facilitating the entry of said clip and said pawl into said recess to engage against said lock shoulders.

6. The system of claim 5 wherein said soffit retainer includes a second leg extending outwardly from said resilient lock leg to form a generally L-shape for providing a space between the lower end of said fascia board and said second leg to receive a soffit therein, and said second leg being resilient.

7. The system of claim 6 wherein said fascia board is indented on said exposed surface downwardly from said recess to receive said resilient lock leg therein, and said resilient lock leg and said exposed surface of said fascia board upwardly from said recess being coplanar.

8. The system of claim 6 in combination with a building structure having a soffit, and said soffit being mounted in said space between said second leg and said lower end of said fascia board.

9. A method of mounting a fascia board to a building structure having a soffit comprising mounting the soffit above a resilient leg of a generally L-shaped soffit retainer interconnecting the soffit retainer to a fascia board which is disposed generally perpendicular to the soffit, the fascia board and soffit retainer being interconnected by snapping a spring clip and a pawl on the soffit retainer into a recess in the fascia board.

10. The method of claim 9 wherein the fascia board and soffit retainer are made of extruded plastic.

* * * * *